US011612781B1

(12) United States Patent
Eoff

(10) Patent No.: US 11,612,781 B1
(45) Date of Patent: Mar. 28, 2023

(54) HIDDEN GYM

(71) Applicant: Loretta Eoff, Huntsville, AR (US)

(72) Inventor: Loretta Eoff, Huntsville, AR (US)

( * ) Notice: Subject to any disclaimer, the term of this patent is extended or adjusted under 35 U.S.C. 154(b) by 116 days.

(21) Appl. No.: 17/217,046

(22) Filed: Mar. 30, 2021

Related U.S. Application Data

(60) Provisional application No. 63/003,846, filed on Apr. 1, 2020.

(51) Int. Cl.

| | |
|---|---|
| ***A63B 21/16*** | (2006.01) |
| ***A47C 1/022*** | (2006.01) |
| ***A63B 21/055*** | (2006.01) |
| ***A63B 21/04*** | (2006.01) |
| ***A47C 7/62*** | (2006.01) |
| ***A47C 9/00*** | (2006.01) |

(52) U.S. Cl.
CPC ..... *A63B 21/1609* (2015.10); *A47C 1/022* (2013.01); *A47C 7/62* (2013.01); *A47C 9/002* (2013.01); *A63B 21/0442* (2013.01); *A63B 21/0552* (2013.01); *A63B 2208/0228* (2013.01); *A63B 2210/02* (2013.01); *A63B 2210/58* (2013.01)

(58) Field of Classification Search
CPC ..... A63B 21/1609; A63B 21/0442; A63B 21/0552; A63B 21/055–0557; A63B 21/4033–4035; A63B 2208/0228; A63B 2210/02; A63B 2210/58; A47C 1/022; A47C 1/02; A47C 1/034–0347; A47C 1/037; A47C 7/62; A47C 7/503; A47C 7/506; A47C 7/5066; A47C 7/5068; A47C 9/002; F16C 29/00–126; F16C 29/0697; F16C 31/00–06
See application file for complete search history.

(56) References Cited

U.S. PATENT DOCUMENTS

| | | | | | |
|---|---|---|---|---|---|
| 1,973,945 | A * | 9/1934 | Chavin | A61G 13/009 | 482/130 |
| 4,913,423 | A * | 4/1990 | Farran | A63B 21/154 | 482/904 |
| 4,921,247 | A * | 5/1990 | Sterling | A63B 21/4035 | 482/130 |
| 5,470,298 | A * | 11/1995 | Curtis | A63B 22/0012 | 482/130 |
| 5,743,838 | A * | 4/1998 | Willis | A63B 21/1609 | 482/125 |
| 6,159,133 | A * | 12/2000 | Shugg | A63B 21/4007 | 482/121 |
| 6,368,260 | B1 * | 4/2002 | Crews | A63B 23/16 | 482/904 |

(Continued)

*Primary Examiner* — Garrett K Atkinson
*Assistant Examiner* — Kathleen M Fisk
(74) *Attorney, Agent, or Firm* — Sandy Lipkin

(57) ABSTRACT

A recliner chair designed to contain elastic bands and other components to turn the recliner into an exercise machine. The recliner has arm rests with cavities therein that can house elastic bands and/or handles for said bands. Additionally, the backrest could have cavities to house additional elastic bands. The leg rest is modified to hold heavier loads than traditional recliners and includes an attachment point for a straight handle or elastic bands for the user to pull from using the upper body. Additionally, the leg rest is convertible to a leg exercise machine that can secure the feet therein for same. The moving portions are adjustable for resistance using various mechanisms.

8 Claims, 13 Drawing Sheets

(56) References Cited

U.S. PATENT DOCUMENTS

| | | | | |
|---|---|---|---|---|
| 6,959,966 | B2 * | 11/2005 | Kristen | A47C 7/5068 297/423.26 |
| 7,357,768 | B2 * | 4/2008 | Marshall | A61H 1/0262 482/148 |
| 7,803,094 | B1 * | 9/2010 | Bolick, Jr. | A63B 21/1609 482/130 |
| 8,696,531 | B1 * | 4/2014 | Spiller | A47C 9/002 482/904 |
| 9,522,293 | B2 * | 12/2016 | Eastwood | A63B 21/4043 |
| 9,770,618 | B2 * | 9/2017 | Wall | A63B 21/0557 |
| 10,960,255 | B2 * | 3/2021 | Bourke | A63B 21/0557 |
| 2009/0108648 | A1 * | 4/2009 | Biggs | A63B 21/16 482/142 |
| 2009/0152915 | A1 * | 6/2009 | Krasna | A47C 7/624 297/217.3 |
| 2020/0046128 | A1 * | 2/2020 | Sramek | A47C 1/02 |
| 2021/0138293 | A1 * | 5/2021 | Bustamante | A63B 21/08 |

* cited by examiner

HIDDEN GYM

REFERENCE TO PRIOR APPLICATION

This application claims priority of the provisional patent application 63/003,846, filed Apr. 1, 2020 entitled HIDDEN GYM by Loretta Eoff.

BACKGROUND OF THE INVENTION

Field of the Invention

The field of this invention relates generally to the field of exercise equipment, and more particularly toward a reclining chair that house components and is configured to allow for the conversion of the reclining chair into a gym through the ability to perform a variety of exercises utilizing the chair and the housed components.

Description of the Prior Art

It can often be advantageous to remain physically fit in the home of the user rather than going to a gym. Additionally, space constraints may make it difficult for a gym to be assembled in some people's homes. Accordingly, it is the primary object of the instant invention to allow for a common piece of household furniture, in this case a reclining chair, to be converted into an exercise machine capable of providing the means to perform a variety of physical fitness exercises.

SUMMARY OF THE INVENTION

The basic embodiment of the present invention teaches a convertible recliner chair comprising: a seat upon which a user can sit; arm rests on either side of said seat; sidewalls extending downward from said arm rests for support; a backrest attached to said seat and said sidewalls; a rear wall extending downward from said back rest at a junction between said backrest and said seat extending down the length of said sidewalls; a leg rest that is parallel to said rear wall and extending downward from said seat which is rotatable from a position perpendicular to said seat to a second position that is substantially parallel and extending outwardly from said seat; one or more cavities incorporated into said arm rests; and a plurality of resistance bands housed inside of said one or more cavities in said arm rests that can be used to attach at chosen points on said recliner chair to be used by said user to perform resistance exercises.

The above embodiment can be further modified by defining that one or more cavities are incorporated into said back rest to house a further plurality of resistance bands.

The above embodiment can be further modified by defining that handles are housed in said one or more cavities incorporated into said arm rests that are attachable to said plurality of resistance bands.

The above embodiment can be further modified by defining that an anchor point is attached to said leg rest wherein one of said plurality of elastic bands can be attached thereto.

The above embodiment can be further modified by defining that a storage tray is incorporated into said one or more cavities in said arm rests to house a plurality of handles wherein said storage tray includes a clearance space for the fingers of said user.

The above embodiment can be further modified by defining that said further plurality of resistance bands incorporated into said back rest can be used by said user to exercise the arms of said user.

The above embodiment can be further modified by defining that the amount of resistance in said resistance bands are adjustable using a tensioner that can shorten the length of said resistance bands wherein said tension further comprises a lever to activate a rod that bends said resistance bands away from an anchor point effectively shortening the distance said elastic bands will travel when pulled thereby increasing the resistance.

The above embodiment can be further modified by defining that a specialized bearing is connected to said armrests through which said plurality of elastic bands can pass therethrough to reduce wear on said elastic bands, said specialized bearing further comprising a substantially hexagonal shape having six dowels connected to each other with each of said six dowels having protective cylinders therearound.

The above embodiment can be further modified by defining that said leg rest is attached to said seat with a rod wherein said rod is further attached to a main base of said leg rest, said leg rest being attached to said seat through one or more cylinders, said main base of said leg rest being movable to said second position.

The above embodiment can be further modified by defining that said main base of said leg rest is movable in to said second position through a pulley system attached thereto and also attached to an actuating mechanism on the outside of one of said sidewalls of said recliner chair.

The above embodiment can be further modified by defining that said actuating mechanism is manually activated through a lever.

The above embodiment can be further modified by defining that said actuating mechanism is manually activated through a knob.

The above embodiment can be further modified by defining that said actuating mechanism is activated through a remote control.

The above embodiment can be further modified by defining that said leg rest is composed of a first cushion and a second cushion wherein said first cushion and said second cushion are substantially parallel and in line with each other and connected to each other with a linkage member wherein said linkage member can be moved into a position wherein said first and second cushions are substantially parallel in a stacked orientation to each other and wherein a space between said first and second cushions is created to provide for the placement therethrough of the lower leg of said user for securing said lower leg of said user therein.

The above embodiment can be further modified by defining that said linkage is moved such that said first and second cushions are substantially perpendicular to each other using a lever.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
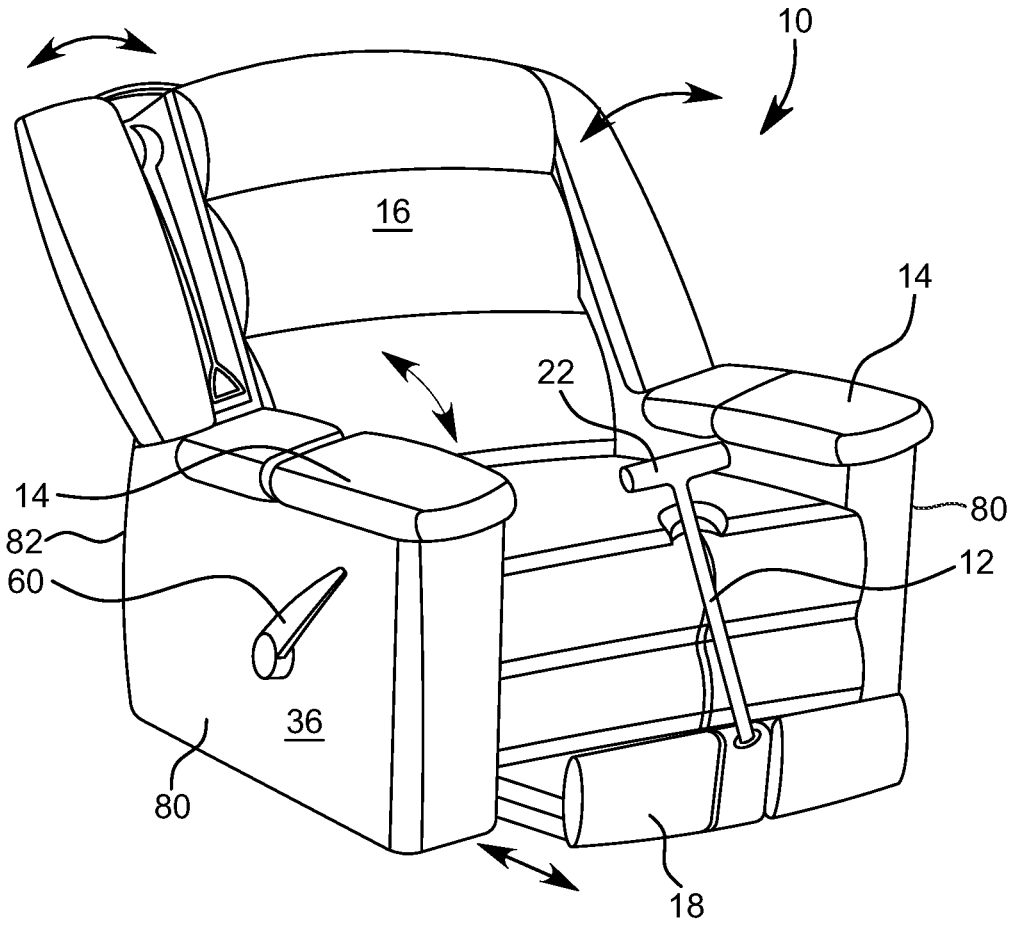
FIG. 1 is an isometric view of the reclining exercise machine of the instant invention in the non-deployed position.
Figure 2:
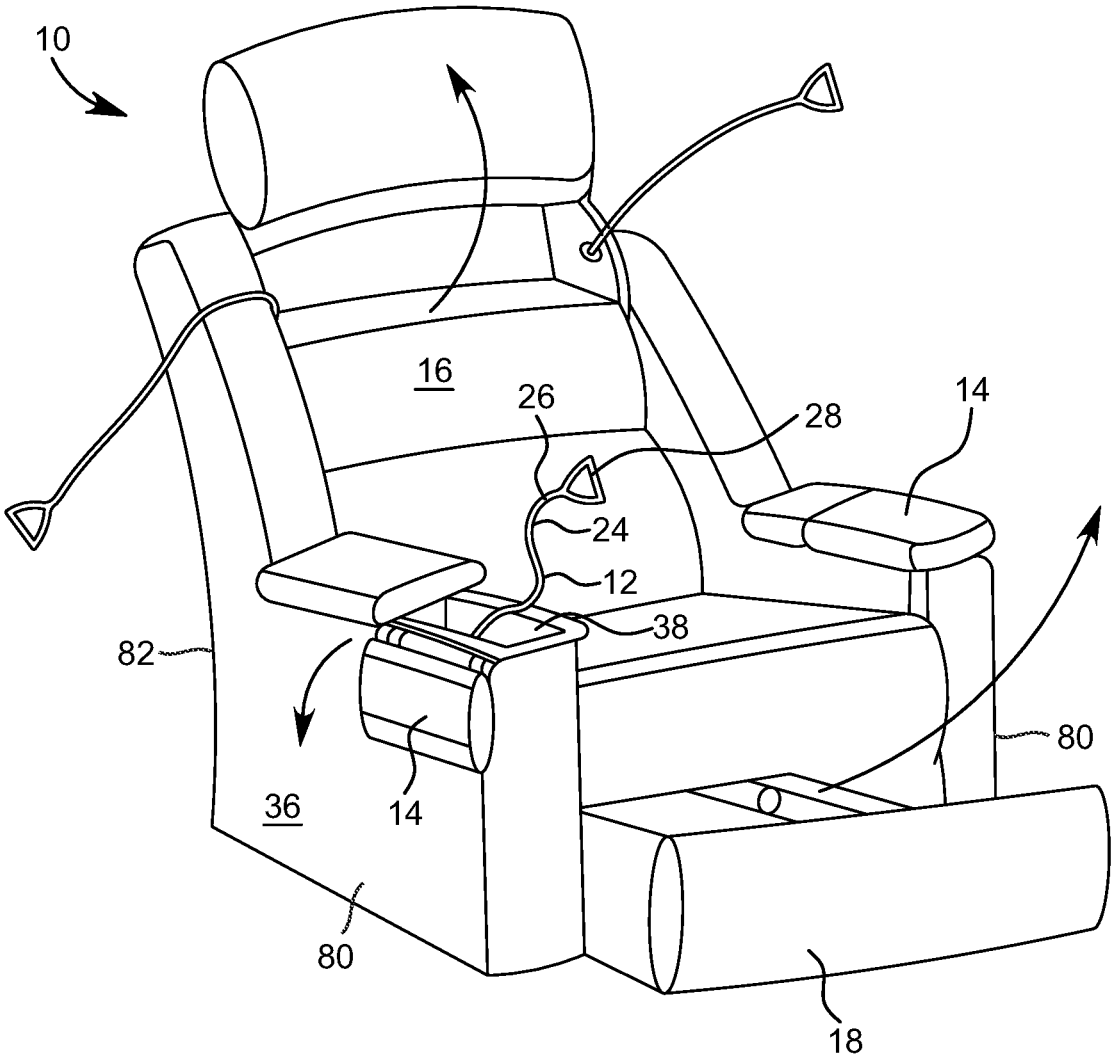
FIG. 2 is the same view as FIG. 1, but in the deployed position.
Figure 3B:
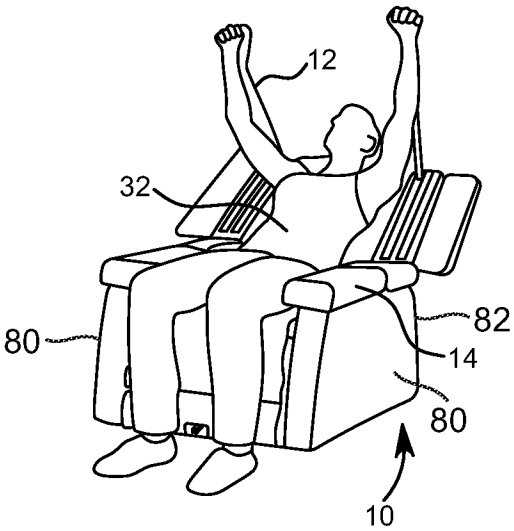
FIG. 3B a front perspective view of the reclining exercise machine of the instant invention with a user in a variety of engagement therewith.
Figure 3A:
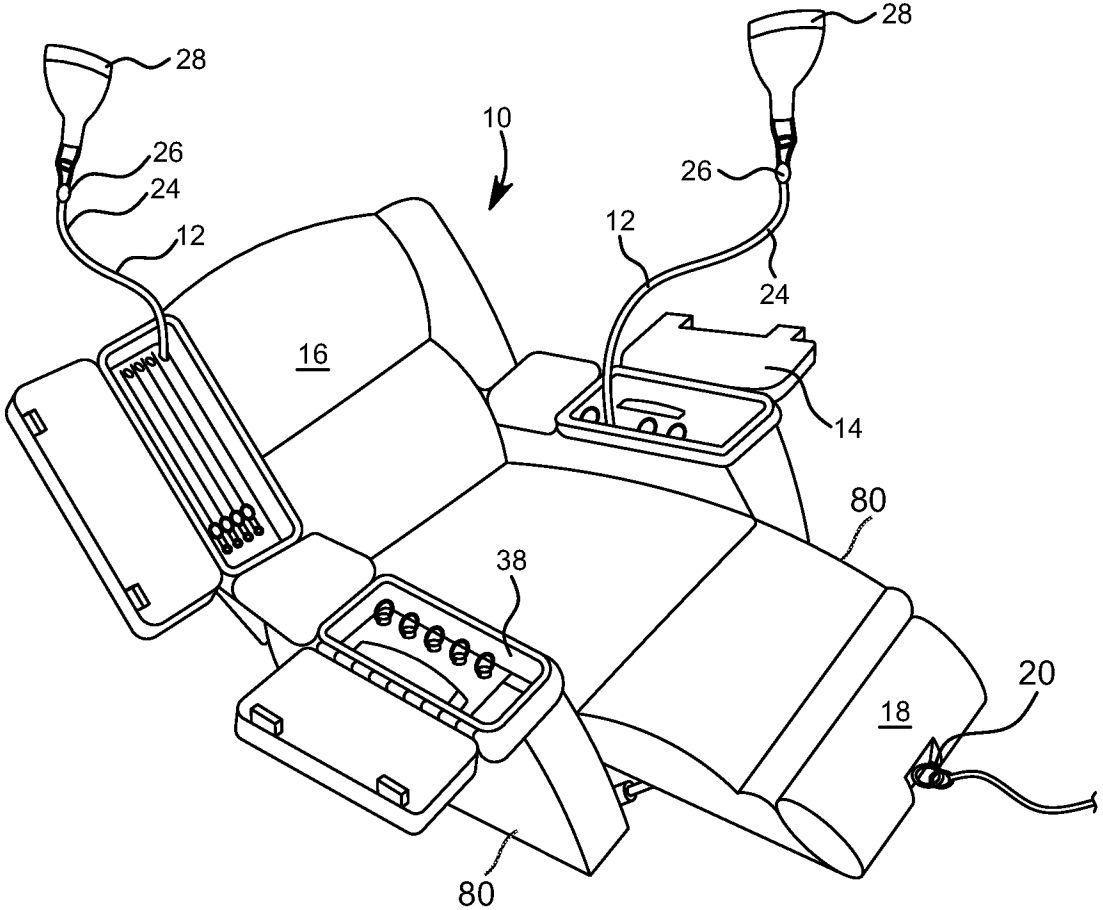
FIG. 3A shows a top isometric view of the reclining exercise machine of the instant invention with all compartments open.
Figure 4:
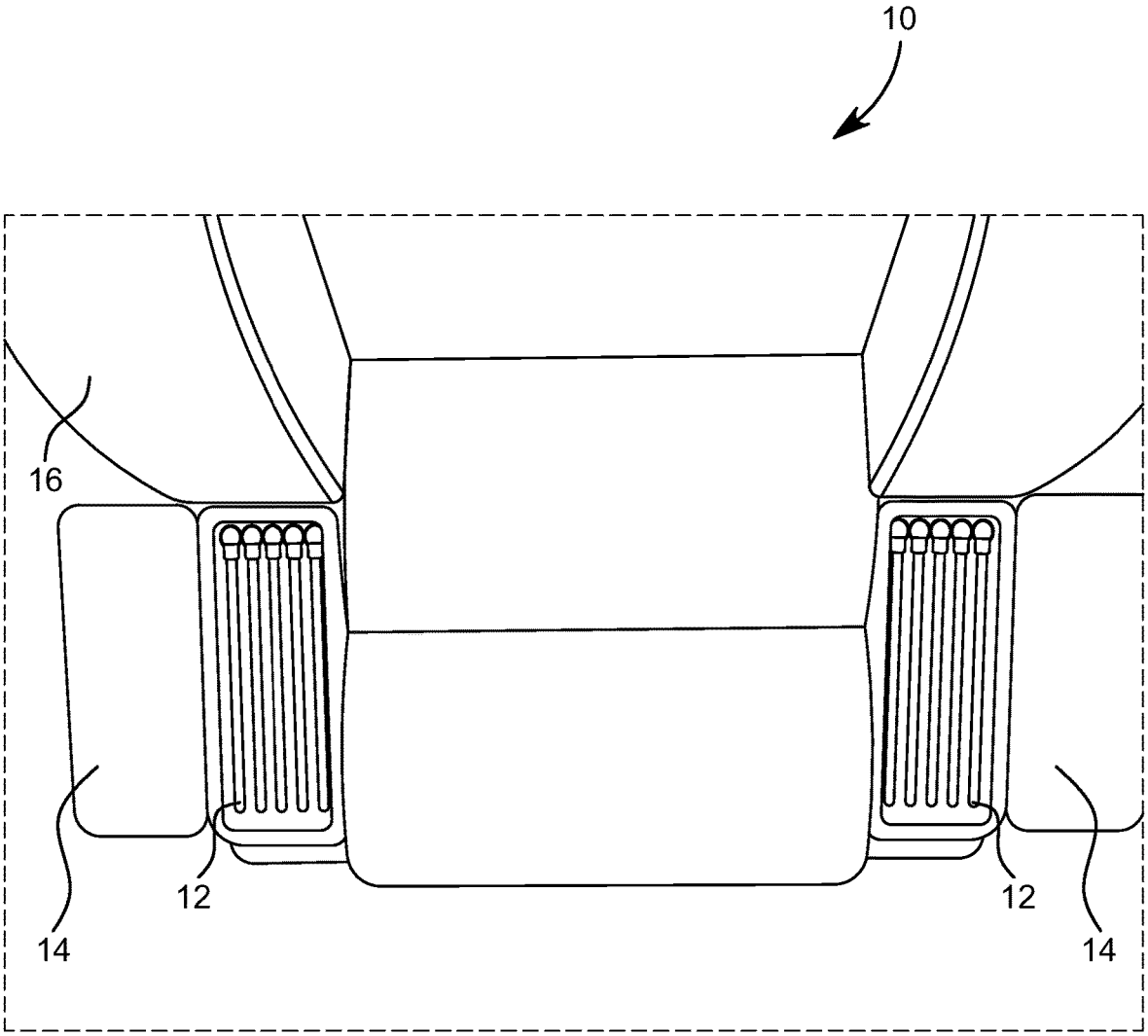
FIG. 4 is a top view of the instant invention showing the hidden compartments with bands housed therein in the horizontal orientation.
Figure 5:
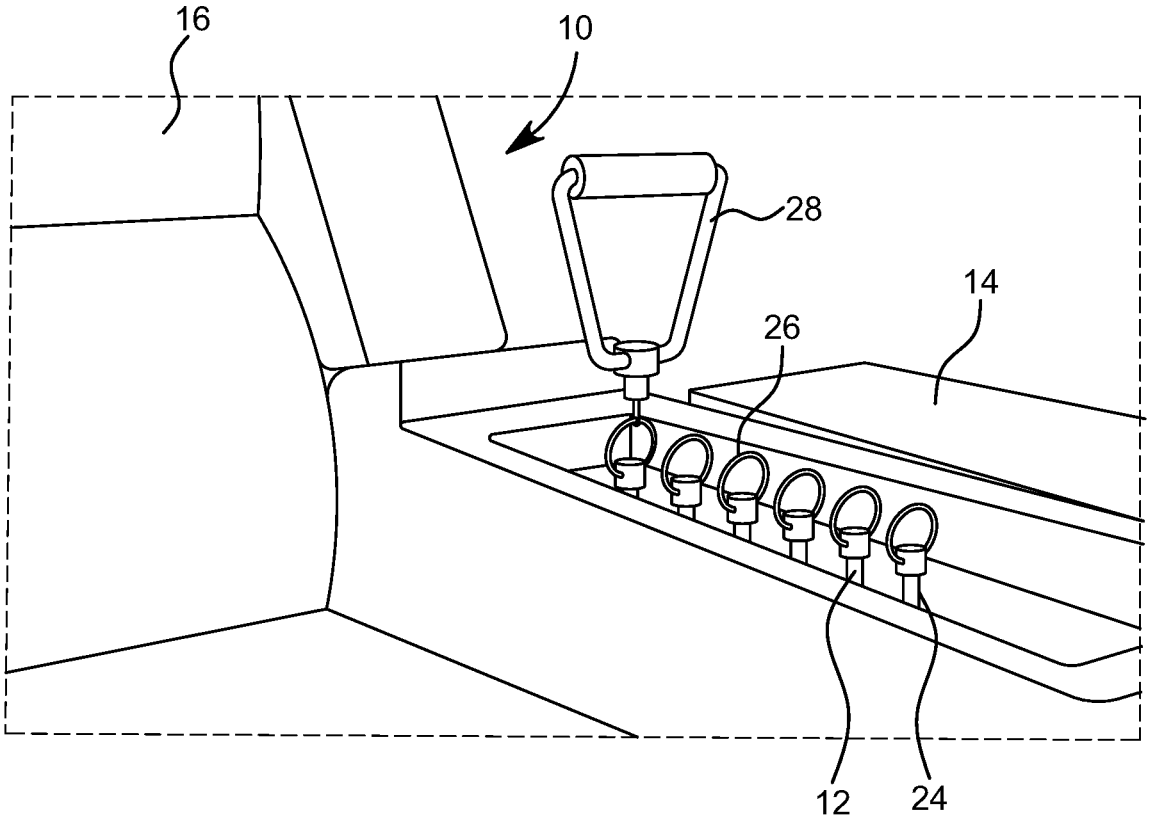
FIG. 5 is a close up view of one of the arm rests with a plurality of bands therein with one of them attached to a handle for use.
Figure 6:
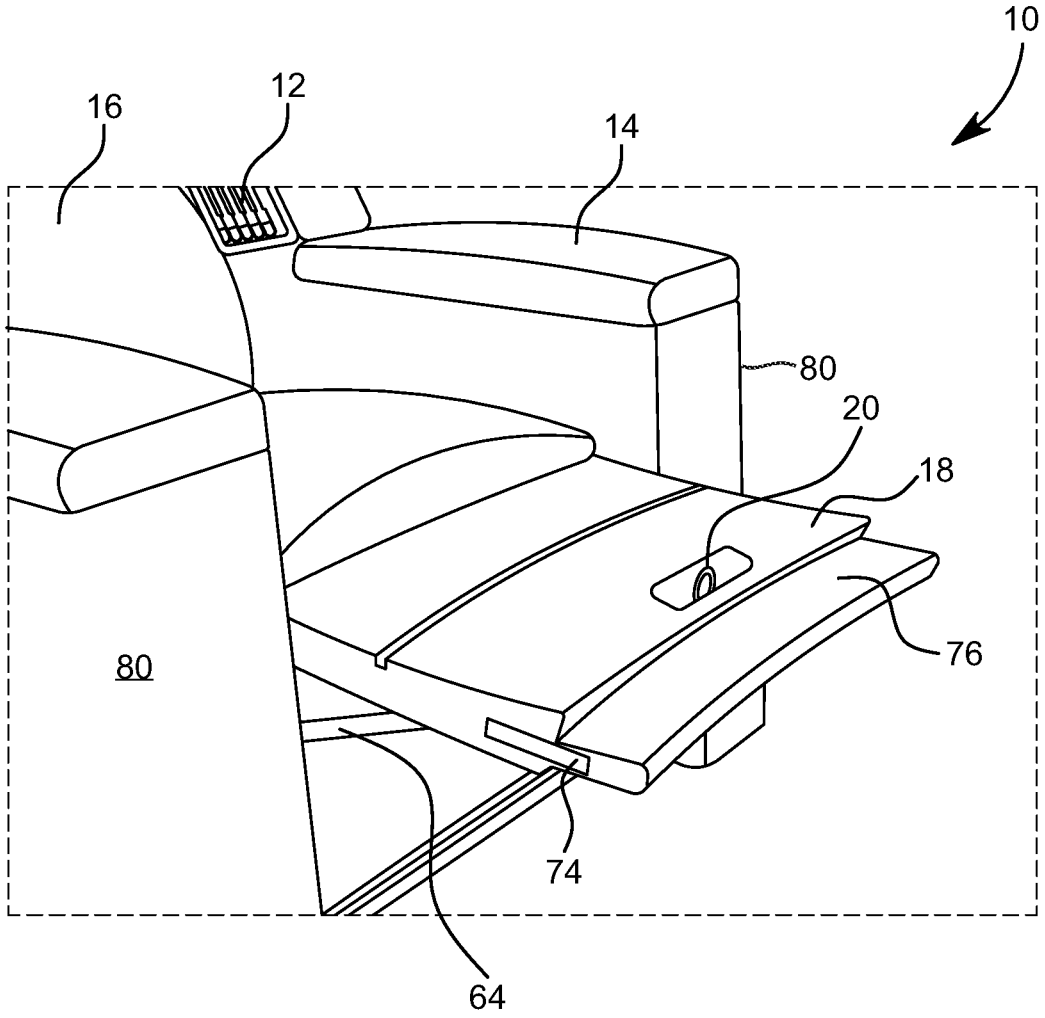
FIG. 6 is a side perspective view of the leg rest exercise attachment in the deployed position.
Figure 7:
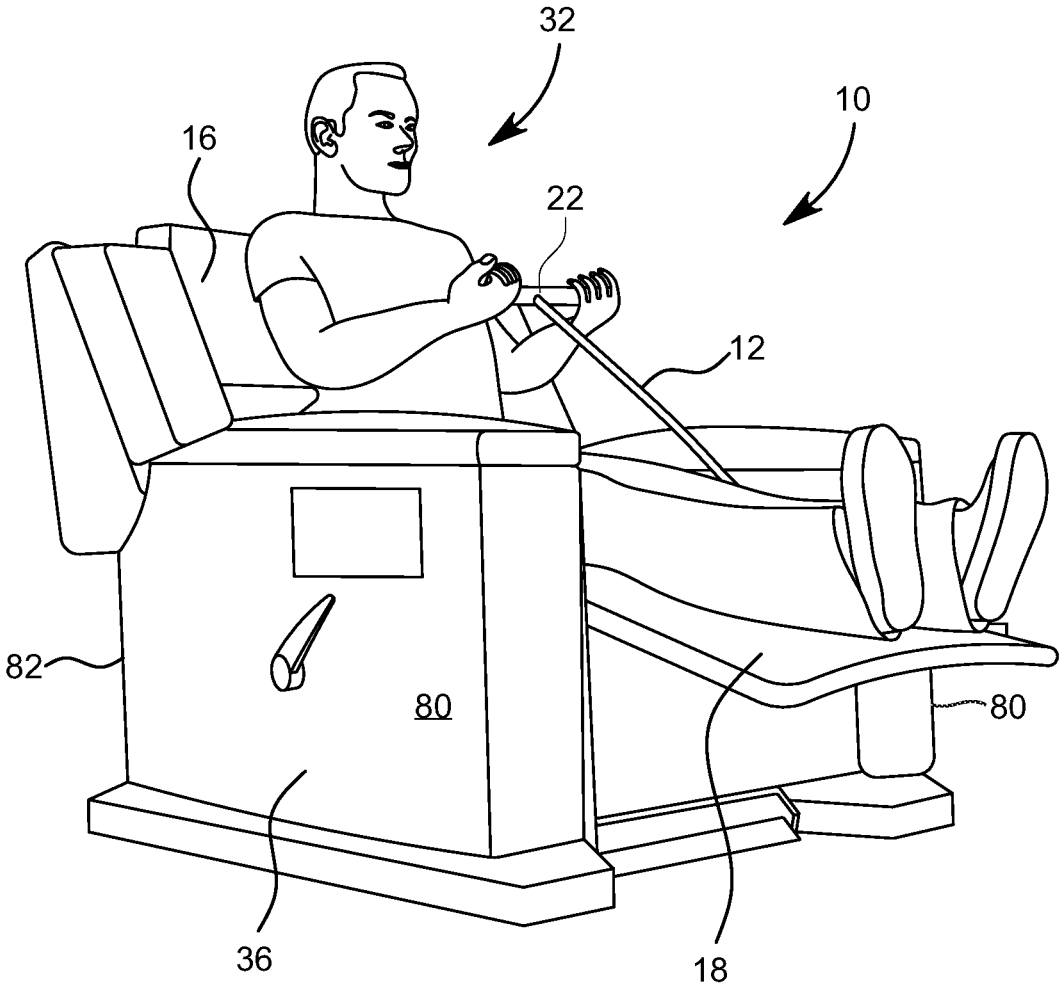
FIG. 7 is a side perspective view of the device of the instant invention with a user using the pulley system attached to the foot rest, with the foot rest in the deployed position.

Turning to the drawings, the preferred embodiment is illustrated and described by reference characters that denote similar elements throughout the several views of the instant invention.

The preferred embodiment of the instant invention provides for a recliner 10 in which a person can exercise and workout various parts of their body. (See FIGS. 1-7.) Often times, it can be difficult for people to maintain a fitness routine and go to the gym, whether due to a lack of mental effort, the physical distance to the gym, or a disability. The device of the instant invention has the conventional functions of an upholstered reclining chair 10 with the addition of multiple arrays, or sets, of resistance bands 12 built into the armrests 14, backrest 16 and leg rest 18.

Figure 9A:
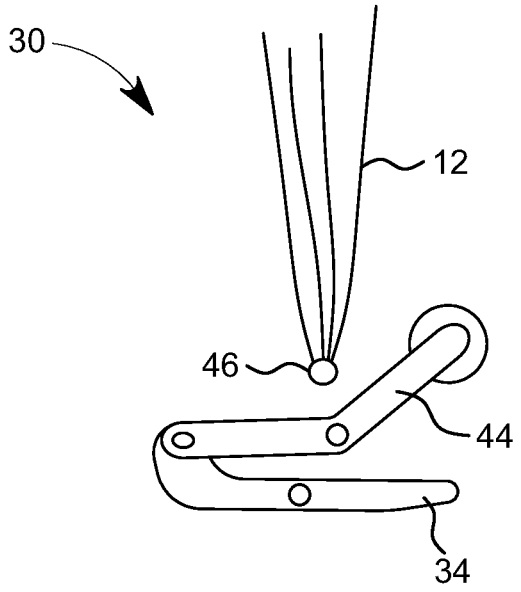
FIG. 9A is a side view of the side lever on the device of the instant invention in the setting for a long band.
Figure 9B:
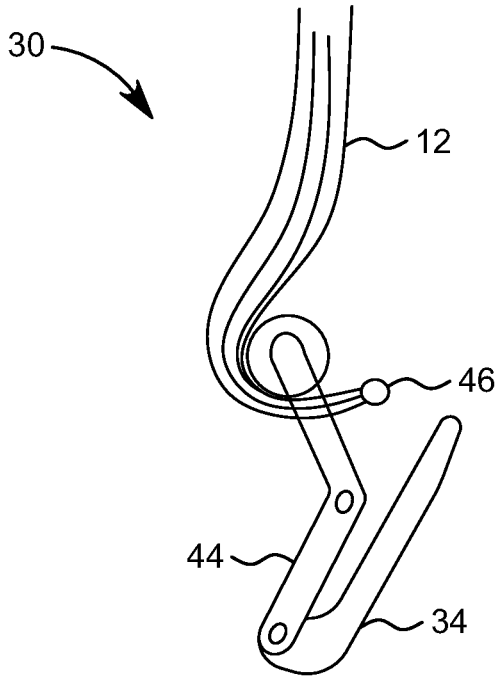
FIG. 9B is a side view of the side lever on the device of the instant invention in the settling for the short band.

A variety of resistances are available with a set of, for example, five bands 12, in which each band provides a different degree of resistance. The leg rest 18, however, may utilize an eye bolt style attachment point 20 for a straight handle 22 and resistance band 12 to be attached. The ends 24 of the bands 12 have a closed loop 26 allowing a handle 28 to be attached to one or any combination of bands 12. Additionally, a tensioner 30 is built into the system allowing the user 32 to effectively shorten the length of the bands 12 for added resistance. Adjustment of the bands' 12 tensions may be done using a knob 34 on the side panel 36 of the recliner 10, in which each set of resistance bands 12 may be given a single adjustment knob 34. (See FIGS. 9A-9B.)

The armrests 14 and backrest 16 fold out to expose resistance bands 12 and the footrest 18 doubles as a leg extension/curl machine. Of course, the product also functions as a comfortable recliner and the workout features can be hidden and go unnoticed. The product allows the user to do multiple exercises targeting the upper and lower body while sitting comfortably in the recliner 10. The armrests 14 have sidewalls 80 extending down to the floor and a rear wall 82 extends across the back of the recliner 10 at the junction of the armrests and the rear wall 82.

Resistance bands 12 are very common and come in a wide range of resistances, length and colors. There are also many different handle attachments 28 on the market. All of these can be customized.

To simplify the design and stay away from the internal linkages and mechanics underneath the recliner 10, the design includes having separate resistant bands 12 for each side. In this way, there shouldn't be any band 12 passing underneath the recliner 10 from left to right. Instead, each of the four handle 28 locations will have a separate set of bands 12 with a separate internal anchor point.

Figure 8A:
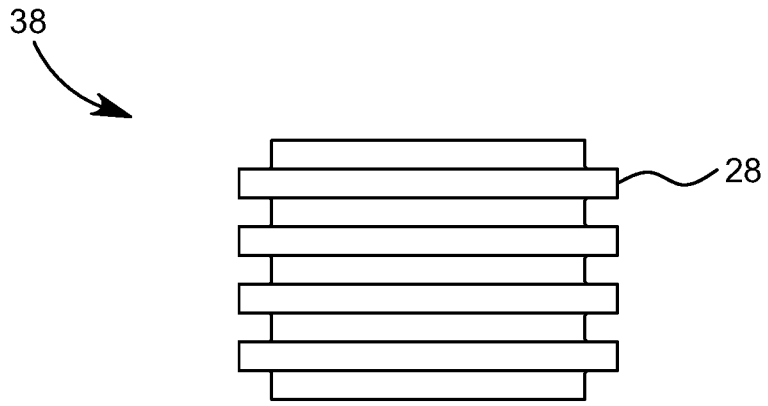
FIG. 8A is a top view of the armrest hidden compartment showing the tray of bands in the horizontal orientation.
Figure 8B:
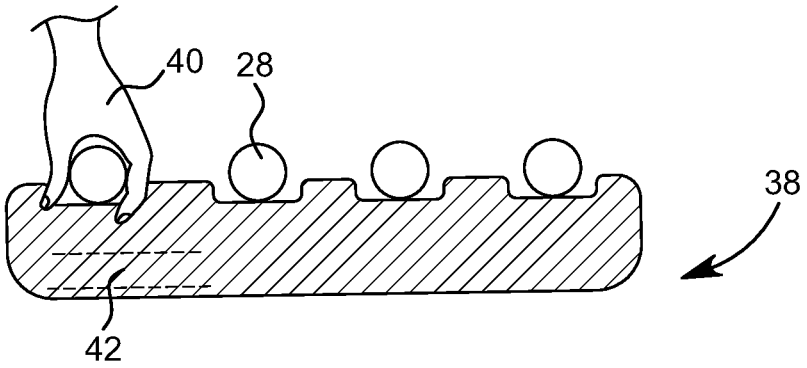
FIG. 8B is a cross sectional view of the side of the tray shown in FIG. 8A illustrate the clearance space for the fingers of the user when grasping one of the bands.

Optionally, to simplify the system even further, one can pre-attach a handle 28 to each band 12. In this way, the user 32 would never have to remove the handle 28 and reattach it to a different band 12. The handles 28 are neatly housed in a plastic tray 38 that's designed to space them out just enough such that the user 32 can fit their fingers 40 in between them to grab the desired handle 28. The handles 28 should also have the resistance value screen-printed on them or possibly be segregated with different colors for easy differentiation. The plastic tray 38 that these handles 28 fit into are designed with a small cavity 42 below the handles 28 for the fingers 40. (See FIGS. 8A-8B.)

Different exercises may require different lengths bands 12. For example, let's examine the bands 12 in the armrest 14. (See FIGS. 4-5.) If one were going to do bicep curls, one would want that bands 12 to be taut from the beginning of the motion. However, if you are doing flies, a chest and shoulder exercise, one wants more slack. To account for this, there can be a knob 34 that changes the effective length of the bands 12. (See FIGS. 9A-9B.) For simplicity, the knob 34 chooses between three lengths settings: short, medium and long. A knob 34 would be pulled moving a rod 44 which in turn drags the band further away from the anchor point 46. This rod 44 would travel from one side of the recliner 10 to the other so that a single knob 34 would effectively change the length of both the left and right set of bands 12.

Figure 10:
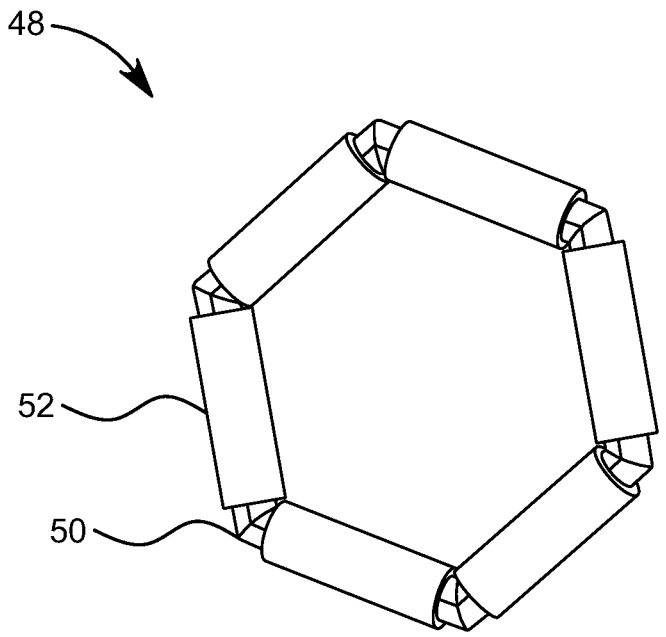
FIG. 10 is a top view of the hexagonal fitting of the device of the instant invention.

The bands 12 needs to pass through of bearing 48 that is located near the opening near the plastic handle tray 38. (See FIG. 10.) The bands 12 are going to be stretched and pulled across this bearing 48 back and forth throughout the product life so this bearing 48 is to prevent fraying/breaking of the bands 12. This bearing 48 is designed such that the user 32 can pull the bands 12 in any direction and it remains functional. The bearing 48 has rotating plastic dowels 50 in a hexagon pattern. The outer tubes 52 can rotate and the hexagon shape provides fewer pinch points for the bands 12 compared to a square shape.

Figure 11A:
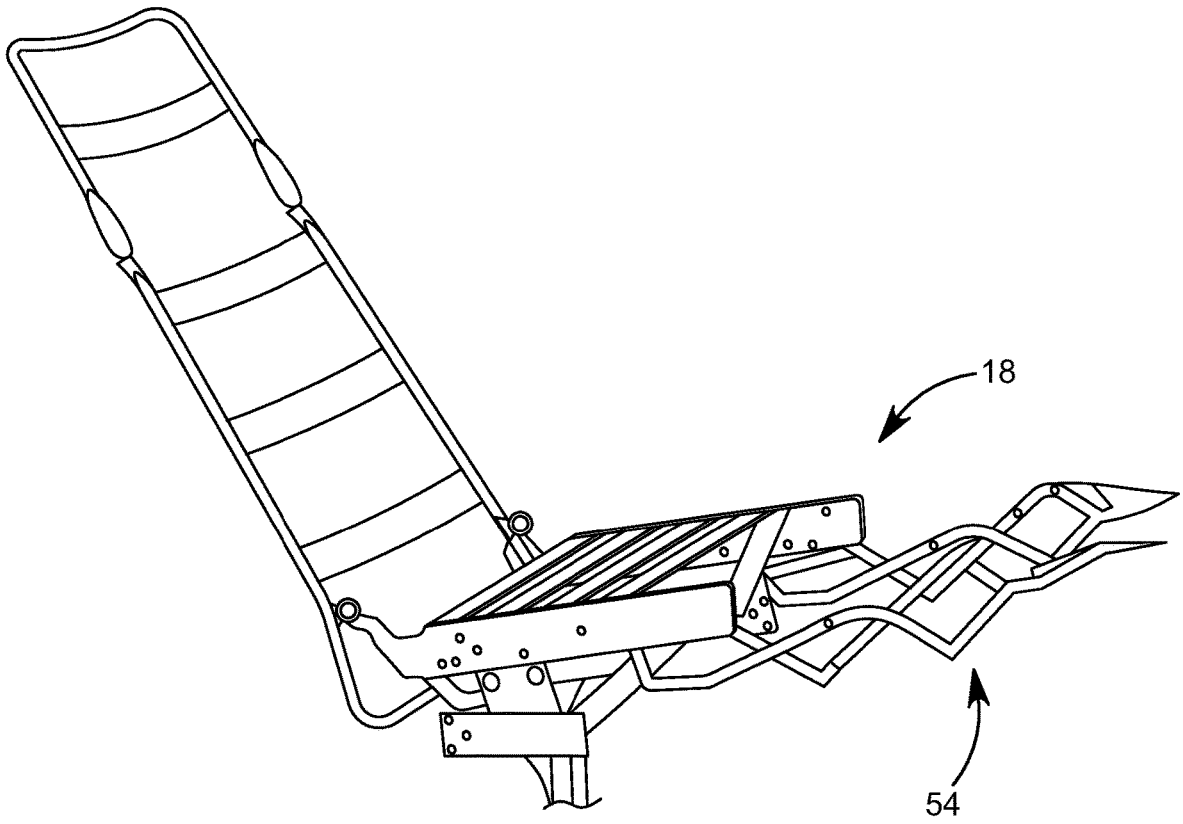
FIG. 11A is a side perspective view showing the internal mechanism for the foot rest of prior typical reclining chairs.

The main difficulty with the leg exercises is that they are not compatible with a standard recliner mechanism. A prior art drawing of the internal mechanism of a typical recliner is shown for comparison in FIG. 11A. Notice how the footrest 18 extends via a scissor mechanism 54. Since the foot rest 18 doesn't rotate about a single pivot point, this mechanism will not work for leg curl/extension exercises. Additionally, it would be too difficult to disengage the scissor mechanism 54 to switch leg exercises, which is why the footrest 18 mechanism has a completely new design altogether. The internal mechanism inside of a typical recliner for reclining the backrest 16 can be maintained, but the footrest 18 reclining function is redesigned and integrated into the rest of the reclining mechanism.

Figure 11B:
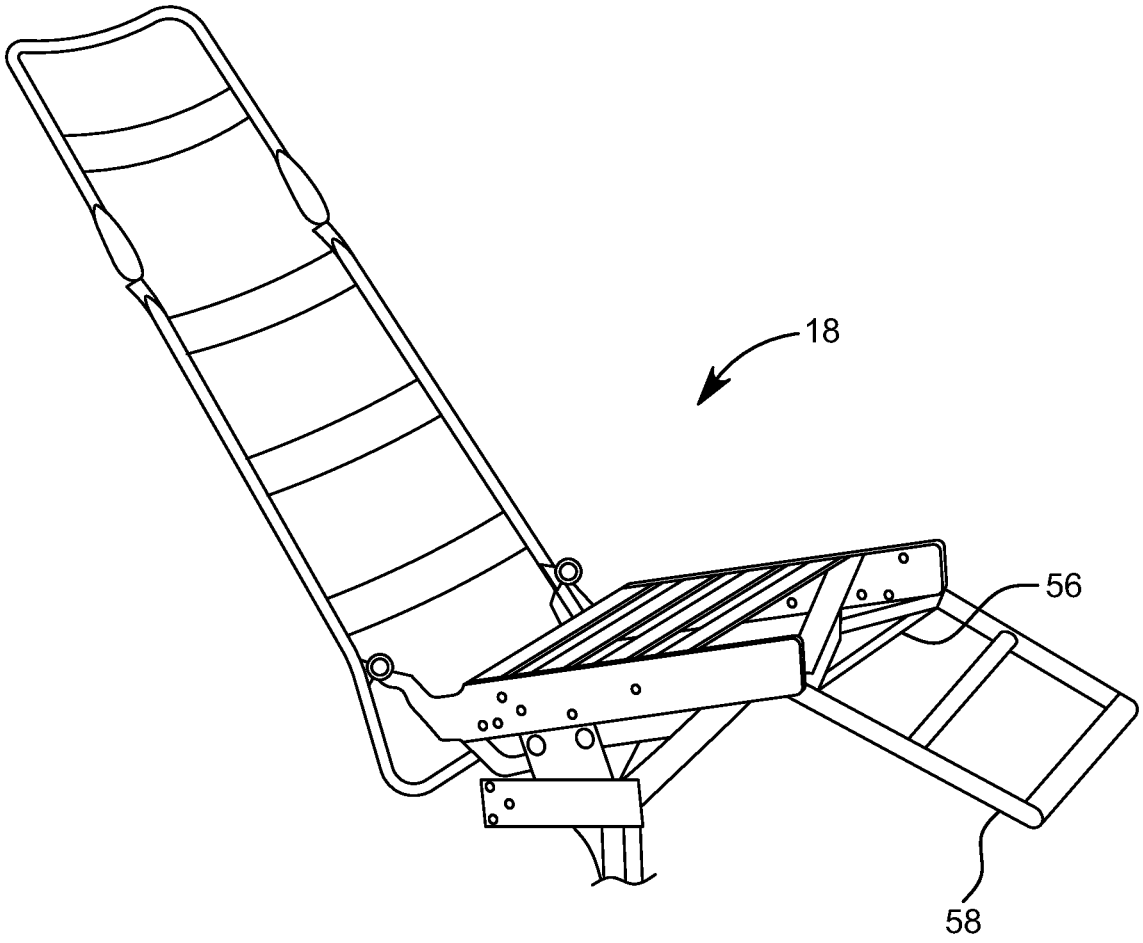
FIG. 11B is a side perspective view showing the internal mechanism for the foot rest as modified from a typical reclining chair into the foot rest of the instant invention.

The footrest 18 reclining mechanism of the instant invention has a single shaft 56 that the footrest 18 rotates on. (See FIG. 11B.) The shaft 56 should be attached to the main base 58 so when the chair is reclined and the base plate 58 slides forward, the foot rest 18 travels with it. The recliner 10 of the instant invention is heavier than average, but the footrest 18 needs to be a lot stronger and stiffer to handle all the loads being applied, especially since it is rotating around a single pivot point.

To integrate this feature into the whole reclined feature of the chair 10, a recliner lever 60 is repurposed to turn a gear on the shaft 56 of the foot rest 18. As the lever 60 is pulled up it does two things. One, it activates the typical reclining mechanism on the backrest 16 and base plate 58 similar to a standard recliner; and two, it's connected to the shaft 56 of the footrest 18 via a chain drive that rotates the footrest 18 out. When the lever 60 is pushed forward, it reverses everything. A knob will need to be located through a slot on the outside of the recliner 10 where the shaft 56 is. When the knob is pulled it disengages this chain drive mechanism via some kind of clutch. This allows the footrest 18 to rotate at will and allows the user 32 to do leg exercises in either the reclined position or in the upright position. To re-engage the rest, the knob is simply pushed back in.

Hydraulic damping cylinders are used instead of a rotational damper. This design is much more structurally sound and the cylinders can be adjustable. The cylinder is attached about midway down the footrest 18. The main body of the cylinder should also be attached to the seat base so it can travel with the base when being reclined.

These cylinders 64 have easy adjustments on them from 1 to 6. However, the problem is that these adjustments will be underneath the recliner 10 and out of reach. To overcome this, there are three options for adjusting these cylinders from a comfortable seated position.

The first option is to use a remote control. There would need to be a small motor mounted to each cylinder to turn the knob. This should be a stepper motor in order to achieve accurate movement. The motor will need to run off of a small replaceable battery. D-size disposables would be a good option. The motor will also need to be able to communicate with the remote. This isn't that difficult to achieve, but it might overcomplicate the product and replacing batteries on the motors might not go over well with the customers.

Another option is to mount the cylinders as close to the outside of the chair 10 is possible. They are positioned so the adjustment knobs are facing outward. The outside of the chair has a flap that can be open to exposed the adjustment knobs.

Lastly, the knobs and the cylinders could be replaced with pulleys. A belt system is used in order to adjust a knob from a single, remote knob that's located outside the chair 10 on the sides. This needs to be belt driven because the adjustment knob on the cylinder will move during the exercises, so this design simplify things. The knobs will have to travel in horizontal slots, however. To account for the reclining function of the recliner 10, when the chair reclines, the base plate moves forward and so does the outer adjustment knobs on the side of the chair 10.

Figure 12A:
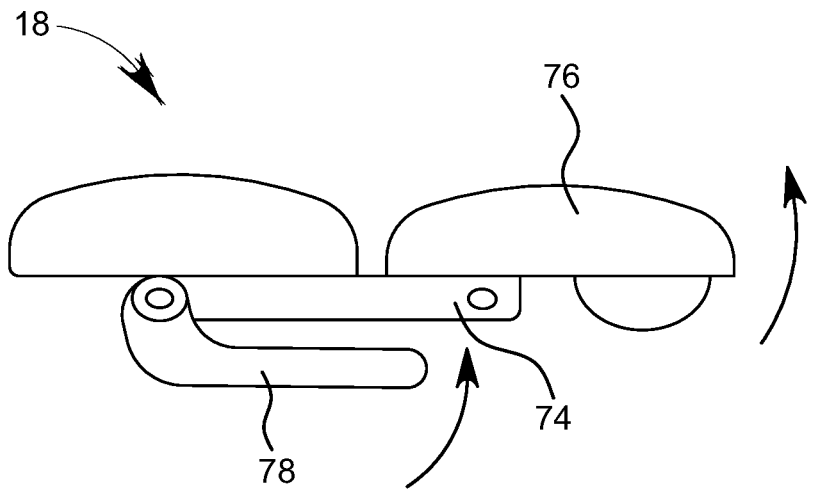
FIG. 12A is a side view of the foot securing section of the foot rest in the non-deployed position.
Figure 12B:
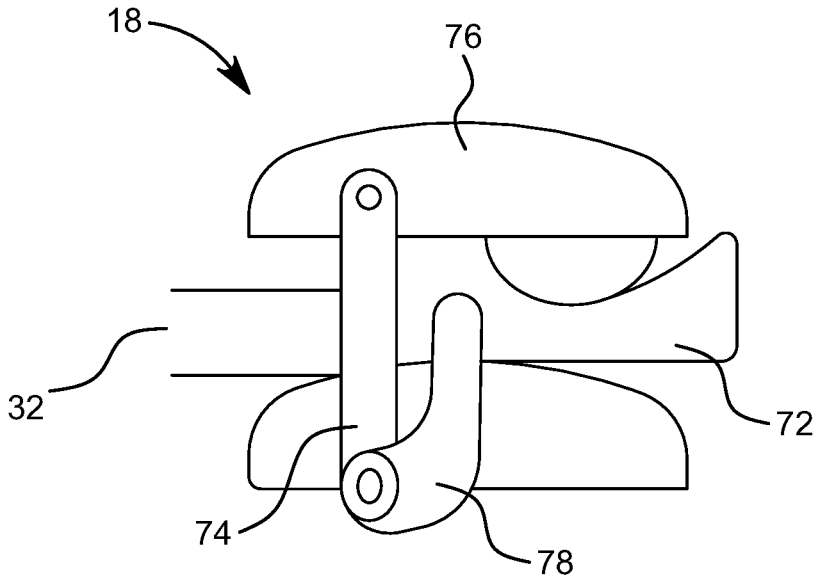
FIG. 12B is the same as the component shown in FIG. 12A but in the deployed position with a foot shown secured therein.

These cylinders resist travel in both directions, so to use this leg exercise function, the user's 32 ankles 72 will have to be supported on both sides. To do this, a linkage 74 allows the bottom cushion 76 to rotate up and backwards and lock into place (See FIGS. 12A-12B.). A discrete lever 78 on the outside can be pulled to rotate the bottom cushion 76 into position. This could also be done without a lever 78 at all. The bottom cushion 76 could just be pulled up and back and it will lock into position automatically. Then to retract it, a single release tab (not shown) is depressed and the pad 76 will fall back into position, held in place by gravity.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A convertible recliner chair comprising:

a seat upon which a user can sit;

arm rests on either side of said seat;

sidewalls extending downward from said arm rests for support;

a backrest attached to said seat and said sidewalls;

a rear wall extending downward from said backrest at a junction between said backrest and said seat extending down the length of said sidewalls;

a leg rest that is parallel to said rear wall and extending downward from said seat which is rotatable from a position perpendicular to said seat to a second position that is substantially parallel and extending outwardly from said seat;

one or more cavities incorporated into said arm rests; and a plurality of resistance bands housed inside of said one or more cavities in said arm rests that is configured to be used to attach at chosen points on said recliner chair to be used by said user to perform resistance exercises, wherein a specialized bearing is connected to said arm rests through which said plurality of resistance bands can pass therethrough to reduce wear on said plurality of resistance bands, said specialized bearing further comprising a substantially hexagonal shape having six dowels connected to each other with each of said six dowels having protective cylinders therearound.

2. The convertible recliner chair as defined in claim 1 wherein one or more cavities are incorporated into said back rest to house a further plurality of resistance bands.

3. The convertible recliner chair as defined in claim 2 wherein said further plurality of resistance bands incorporated into said back rest are configured to be used by said user to exercise the arms of said user.

4. The convertible recliner chair as defined in claim 1 wherein handles are housed in said one or more cavities incorporated into said arm rests that are attachable to said plurality of resistance bands.

5. The convertible recliner chair as defined in claim 1 wherein an anchor point is attached to said leg rest wherein one of said plurality of resistance bands can be attached thereto.

6. The convertible recliner chair as defined in claim 1 wherein a storage tray is incorporated into said one or more cavities in said arm rests to house a plurality of handles wherein said storage tray includes a clearance space for the fingers of said user.

7. The convertible recliner chair as defined in claim 1 wherein the amount of resistance in said resistance bands is adjustable using a tensioner that can shorten the length of said resistance bands wherein said tensioner further comprises a lever to activate a rod that bends said resistance bands away from an anchor point effectively shortening the distance said resistance bands will travel when pulled thereby increasing the resistance.

8. The convertible recliner chair as defined in claim 1 wherein said leg rest further comprises a first cushion and a second cushion wherein said first cushion and said second cushion are substantially parallel and in line with each other and connected to each other with a linkage member wherein said linkage member can be moved into a position wherein said first and second cushions are substantially parallel in a stacked orientation to each other and wherein a space between said first and second cushions is created to provide for the placement therethrough of the lower leg of said user for securing said lower leg of said user therein.

* * * * *